US011488789B2

(12) United States Patent
Hejub et al.

(10) Patent No.: US 11,488,789 B2
(45) Date of Patent: Nov. 1, 2022

(54) CONTACT SYSTEM FOR AN ON-LOAD TAP CHANGER

(71) Applicant: Maschinenfabrik Reinhausen GmbH, Regensburg (DE)

(72) Inventors: Emir Hejub, Regensburg (DE); Nikolaus Unterreiner, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 17/056,007

(22) PCT Filed: May 15, 2019

(86) PCT No.: PCT/EP2019/062487
§ 371 (c)(1),
(2) Date: Nov. 17, 2020

(87) PCT Pub. No.: WO2019/219750
PCT Pub. Date: Nov. 21, 2019

(65) Prior Publication Data

US 2021/0233721 A1 Jul. 29, 2021

(30) Foreign Application Priority Data

May 18, 2018 (DE) ..... 102018112013.3

(51) Int. Cl.
*H01H 1/50* (2006.01)
*H01H 3/44* (2006.01)
(Continued)

(52) U.S. Cl.
CPC ..... *H01H 9/0016* (2013.01); *H01H 1/50* (2013.01); *H01H 3/44* (2013.01); *H01H 9/0027* (2013.01); *H01H 9/383* (2013.01); *H01H 9/386* (2013.01)

(58) Field of Classification Search
CPC combination set(s) only.
See application file for complete search history.

(56) References Cited

U.S. PATENT DOCUMENTS 3,551,628 A 12/1970 Bleibtreu
4,781,603 A * 11/1988 Olsson ..... H01R 4/64 439/95

(Continued)

FOREIGN PATENT DOCUMENTS

DE 1765467 B1 5/1971
DE 3403478 * 8/1984

(Continued)

*Primary Examiner* — Rexford N Barnie
*Assistant Examiner* — Xuan Ly
(74) *Attorney, Agent, or Firm* — Leydig, Voit & Mayer, Ltd.

(57) ABSTRACT

An on-load tap changer has a contact system. The contact system includes: a fixed contact; a movable contact; and an auxiliary contact. The moveable contact is configured to directly contact, in a stationary state, the fixed contact. The auxiliary contact is configured to electrically connect, in addition to the direct contact, the movable contact with the fixed contact in the stationary state. The auxiliary contact is constructed and arranged to conduct a current between the fixed contact and the movable contact in the event of interruption of the direct contacting.

14 Claims, 2 Drawing Sheets

(51) Int. Cl.
*H01H 9/00* (2006.01)
*H01H 9/38* (2006.01)

(56) References Cited

U.S. PATENT DOCUMENTS

| | | | |
|---|---|---|---|
| 5,172,088 | A | 12/1992 | Morgan |
| 10,643,802 | B2 | 5/2020 | Hammer et al. |
| 2010/0186993 | A1 | 7/2010 | Yamaguchi et al. |

FOREIGN PATENT DOCUMENTS

| | | | | |
|---|---|---|---|---|
| DE | 3403478 | A1 | | 8/1984 |
| DE | 102014107273 | | * | 11/2015 |
| DE | 102014107273 | A1 | | 11/2015 |
| DE | 102016104499 | | * | 4/2017 |
| DE | 102016104499 | B3 | | 4/2017 |
| EP | 0324262 | A1 | | 7/1989 |

* cited by examiner

CONTACT SYSTEM FOR AN ON-LOAD TAP CHANGER

CROSS-REFERENCE TO PRIOR APPLICATIONS

This application is a U.S. National Phase Application under 35 U.S.C. § 371 of International Application No. PCT/EP2019/062487, filed on May 15, 2019, and claims benefit to German Patent Application No. DE 10 2018 112 013.3, filed on May 18, 2018. The International Application was published in German on Nov. 21, 2019, as WO 2019/219750 A1 under PCT Article 21(2).

FIELD

The invention relates to a contact system for an on-load tap changer, to a selector device for an on-load tap changer with such a contact system and to an on-load tap changer with such a contact system or such a selector device.

BACKGROUND

On-load tap changers are used for uninterrupted switching over between different winding taps of inductive operating means, for example a transformer or a choke. A basic problem in that case is the occurrence of arcs between current-conducting contacts of the on-load tap changer. Such arcs arise when a closed contact pair opens while current flows across the contact pair. On the one hand, this can be an intentional opening, in particular when the current is to be switched off. On the other hand, however, the opening can also be unintentional, for example when external oscillations, vibrations or force impulses act on the on-load tap changer or when internal movement sequences in the on-load tap changer transmit force impulses to the contacts.

The contacts can be surrounded by an insulating liquid, for example an insulating liquid of the on-load tap changer. However, the contacts can also be directly surrounded by an insulating liquid of the operating means. In both cases, arcs have the consequence, due to combustion products, of an impairment of quality, particularly increased electrical conductivity, of the insulating liquid and thus reduce the maintenance intervals or the service life of the on-load tap changer or the operating means.

In addition, the arcs also lead to increased wear, particularly erosion, of the contacts. In addition, the maintenance intervals or the service life of the on-load tap changer is or are thereby shortened.

SUMMARY

An embodiment of the present invention provides a contact system for on-load tap changer. The contact system includes: a fixed contact; a movable contact; and an auxiliary contact. The moveable contact is configured to directly contact, in a stationary state, the fixed contact. The auxiliary contact is configured to electrically connect, in addition to the direct contact, the movable contact with the fixed contact in the stationary state. The auxiliary contact is constructed and arranged to conduct a current between the fixed contact and the movable contact in the event of interruption of the direct contacting.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
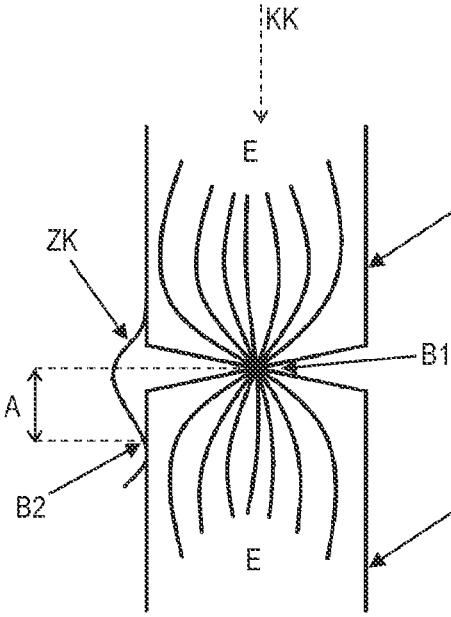
FIGS. 1A and 1B show a schematic illustration of an exemplifying form of embodiment of a contact system according to the improved concept.

Embodiments of the present invention provide an improved concept for a contact system for on-load tap changers, by which formation of arcs is reduced.

The improved concept includes providing an auxiliary contact in a contact system for an on-load tap changer with a movable contact and a fixed contact. In that case, the auxiliary contact serves for temporary bridging over of a movable contact and a fixed contact in the case of interruption of the direct contacting of the movable contact and the fixed contact, particularly an unintended interruption, i.e., an interruption due to external or internal disturbances or movement sequences. Formation of an arc between the movable contact and the fixed contact is avoided by diversion of the current over the path of least resistance, i.e., the auxiliary contact.

According to an embodiment of the present invention, and improved contact system for an on-load tap changer is provided. The contact system comprises a movable contact, occasionally also called moved contact, and a fixed contact as well as an auxiliary contact. The movable contact is arranged in such a way and equipped for such a purpose that it directly contacts the fixed contact in a stationary state, and thus comes into mechanical and electrical connection therewith. In addition to this direct contacting, in the stationary state there is indirect contacting of the movable contact with the fixed contact by the auxiliary contact. During the stationary state, the auxiliary contact electrically connects the movable contact with the fixed contact, as a result of which, in particular, a parallel current path is formed. In addition, the auxiliary contact is constructed and arranged in such a way that in the event of interruption of the direct contacting it can conduct a current between the fixed contact and movable contact, in particular a current which prior to the interruption had flowed substantially by way of the direct contacting.

In this context, interruption means that the mechanical connection between movable contact and fixed contact is temporarily interrupted and is immediately reinstated after the interruption. In particular, in that case, it is an unintended interruption and not, for example, an intended opening which is required for, for example, performance of a switching-over action of the on-load tap changer.

If an on-load tap changer with the contact system is incorporated in an inductive operating means, particularly a transformer or a choke, according to at least one form of embodiment, the movable contact and the fixed contact are disposed in direct contact with an insulating liquid of the on-load tap changer or of the operating means.

According to at least one form of embodiment, during the stationary state, a contact force is exerted by the movable contact on the fixed contact or, due to the third law of Newton, also a corresponding opposing force. The contact force can be produced by, for example, a spring, particularly a biased compression spring, which presses the movable contact in the direction of the fixed contact.

According to at least one form of embodiment, the direction of the contact force is not collinear. In particular, the contact force is perpendicular to a movement direction of the movable contact relative to the fixed contact when switching-over of the on-load tap changer takes place. This applies especially in the stationary state.

According to at least one form of embodiment the interruption corresponds with creation of a spacing, in particular a contact spacing, in a direction opposite to the contact force between the movable contact and the fixed contact.

According to at least one form of embodiment, the auxiliary contact is constructed and arranged to conduct the current between the fixed contact and movable contact at the time of interruption of the direct contacting insofar as the spacing is not greater than a maximum contact spacing.

The maximum contact spacing corresponds with the spacing, particularly parallel to the contact force, between movable contact and fixed contact which is to be expected as a maximum when the interruption occurs, for example inclusive of a tolerance or safety margin and/or an addition to take into account geometric realities. The geometric realities can be, for example, the shape of the movable contact and/or the shape of fixed contact.

The maximum contact spacing can therefore also depend on the contact force and the circumstances, which lead to the interruption. These circumstances can include, for example, the mechanical coming together of further components of the on-load tap changer. In this case, these are internal movement sequences in the on-load tap changer, which by themselves or in combination can cause a direct or an indirect pulse transmission to the movable contact, and thus, the interruption, also called bouncing or lifting off. However, these circumstances can also include external vibrations or oscillations, for example of the operating means, or transmission of impulses from outside the on-load tap changer to the on-load tap changer and the movable contact, which by themselves or in combination with other internal or external circumstances cause the interruption.

Taking into consideration the conservation of momentum in closed systems, estimated values for the respective individual case can be calculated. In the case of usual dimensions of an on-load tap changer, these can be values in the order of magnitude of 10 μm or less than 10 μm up to less than 100 μm for the maximum contact spacing.

As described, in the case of interruption, the auxiliary contact bridges over the spacing, which arises between movable contact and fixed contact. As a result, a current which flowed directly between movable contact and fixed contact prior to the interruption can flow via the auxiliary contact during the interruption. Because the electrical resistance of the spacing, which, for example, is filled with insulating liquid, is much larger than that of the auxiliary contact, no arc forms, whereby the afore-mentioned problems are solved.

In that connection, the duration in time of the interruption is typically very short, for example in the order of magnitude of several 100 μs, for example approximately 500 μs. The thermal loading of the auxiliary contact is thus very small, so that even in the case of the high current strengths of several 100 A to several 1000 A, typically arising in an on-load tap changer, very small conductor cross-sections, and thus masses, for the auxiliary contact suffice. The mass of the auxiliary contact can thus be smaller than that of the movable contact by one or several orders of magnitude.

According to at least one form of embodiment, the auxiliary contact is mechanically coupled with the fixed contact.

According to at least one form of embodiment, the auxiliary contact is mechanically coupled with the movable contact in such a way that it moves in company with the movable contact.

Movement in company is to be understood in the sense that the auxiliary contact moves together with the movable contact when the auxiliary contact is moved from the fixed contact to a further fixed contact or conversely, e.g., particularly during a switching-over process of the on-load tap changer. Movement in company is not to be understood in the sense that the auxiliary contact moves together with the movable contact in the case of the interruption, in particular parallel to the contact force. The latter is indeed possible in different forms of embodiment, but not the case in other forms of embodiment.

It is advantageous with the mechanical coupling of the auxiliary contact with the movable contact that, in the case of several fixed contacts that can be connected by the movable contact, such as is usual for on-load tap changers, only one auxiliary contact is required.

The term mechanical coupling embraces, for example, releasable connections such as plugging on, clipping, or similar, as well as fixed connections such as gluing, soldering, or the like.

According to at least one form of embodiment, the movable contact, in the stationary state, contacts the fixed contact at a first region of the fixed contact and the auxiliary contact contacts the fixed contact at a second region of the fixed contact. The first and second regions have a mutual spacing, which is larger than or equal to a predetermined minimum spacing.

The contact at the first region produces the direct contacting between movable contact and fixed contact, and the contact at the second region produces the indirect contacting between movable contact and fixed contact via the auxiliary contact.

The spacing is to be understood here as, in particular, spacing in a direction parallel to the contact force, thus as an amount of the projection of the shortest connection vector between first and second regions in the direction of the contact force.

According to at least one form of embodiment, the spacing between first and second regions is greater than or equal to the maximum contact spacing between movable contact and fixed contact.

This is to ensure a possibility that, in the event of the interruption, the indirect contacting via the auxiliary contact is maintained and no arc arises.

According to at least one form of embodiment, the auxiliary contact is constructed as, in particular, an intrinsically resilient blade or sheet-metal strip, which is fixedly connected with the movable contact and is pressed against the surface of the fixed contact during the stationary state. During the interruption, the auxiliary contact wipes along the fixed contact, whereby the electrical contact is maintained.

According to at least one form of embodiment, in the stationary state a further contact force, which is parallel to the contact force, from the auxiliary contact to the fixed contact is exerted. At least a part of the auxiliary contact and the movable contact are movable relative to one another in the direction of the contact force.

The part of the auxiliary contact is, for example, in direct contact with the fixed contact during the stationary state. Because the auxiliary contact and the movable contact are movable relative to one another, the direct contact between the auxiliary contact and the fixed contact can also be maintained during the interruption, as a result of which, formation of an arc is avoided. This applies particularly when the mass of the auxiliary contact is significantly smaller than that of the movable contact.

According to at least one form of embodiment, the part of the auxiliary contact movable relative to the movable contact is, in the stationary state, biased against the fixed contact. This is to ensure a further possibility that in the event of the interruption the indirect contacting by way of the auxiliary contact is maintained and no arc arises.

According to at least one form of embodiment, a mass of the auxiliary contact is smaller than a mass of the movable contact by at least an order of magnitude, thus a factor 10.

According to at least one form of embodiment, the movable contact consists at least in part of a solid material, for example copper, or a solid metal alloy, particularly to ensure low electrical resistance and high current-carrying capability.

According to at least one form of embodiment, the auxiliary contact consists at least in part of a copper alloy, for example a bronze, particularly a beryllium bronze or beryllium copper such as, for example, $CuBe_2$, or a tin bronze such as, for example, $CuSn_6$.

A high degree of mechanical load-bearing capability with a sufficiently low electrical resistance is thereby achieved. In particular, the demand on the electrical resistance of the auxiliary contact is less than on that of the movable contact. This is due to the fact that the auxiliary contact has to carry a current only during the relative short duration of the interruption, whereas the movable contact has to permanently conduct the current.

According to at least one form of embodiment, the auxiliary contact is of inherently resilient construction, i.e. is at least in part resiliently deformable. In particular, the auxiliary contact is constructed as sheet-metal strip formed in correspondence with the given physical conditions.

According to at least one form of embodiment, the auxiliary contact is resiliently attached to or mounted on the movable contact.

According to at least one form of embodiment, the auxiliary contact is resiliently attached to or mounted on a component, which moves in company with the movable contact, of the contact system or the on-load tap changer.

The component can be, for example, a shaft, a gearwheel or a Geneva wheel.

In accordance with the improved concept, a selector device, selector for short, comprising a contact system according to the improved concept, is also indicated.

According to at least one form of embodiment, the selector device comprises an insulating plate with a first side and a second side, wherein the second side is opposite the first side. The movable contact is arranged on the first side. The contact system comprises a further movable contact, which is arranged on the second side. The further movable contact is arranged for the purpose of directly contacting the fixed contact. In particular, the movable contact and the further movable contact can, in the stationary state, both directly contact the same movable contact.

According to at least one form of embodiment, the selector device is arranged for the purpose of switching over the movable contact from a further fixed contact of the contact system to the fixed contact and thereafter switching over the further movable contact from the further fixed contact or from a further fixed contact to the fixed contact. In other words, the fixed contact can be regarded as a first fixed contact, the further fixed contact as a second fixed contact, and the additional further fixed contact as a third fixed contact.

According to at least one form of embodiment, the selector device comprises a Geneva wheel, which is attached to the insulating plate to be rotatable about an axis, and is arranged on the first side, and which carries the movable contact.

According to at least one form of embodiment, the auxiliary contact is resiliently attached to or mounted on the Geneva wheel, e.g., by means of a spring.

According to at least one form of embodiment, the selector device comprises a further Geneva wheel, which is attached to the insulating plate to be rotatable about the axis or a further axis, and is arranged on the second side, and which carries the further movable contact.

According to the improved concept there is also provided an on-load tap changer that comprises a contact system and/or a selector device according to the improved concept.

According to at least one form of embodiment the on-load tap changer is constructed for the purpose of current-free switching-over of the movable contact from the fixed contact to the further fixed contact of the contact system and/or conversely. By contrast, in the stationary state a current can flow between movable contact and fixed contact. This applies correspondingly to a further stationary state in which the movable contact directly contacts the further fixed contact.

This means that the movable contact and the fixed contact are designed for the purpose of conducting high levels of current, but not necessarily also for the purpose of switching high levels of current. Such contacts are usually optimised with respect to the electrical resistance thereof, but not necessarily with respect to the capability of resistance thereof relative to arcs. The improved concept is therefore particularly advantageous in this area.

According to the improved concept, an inductive operating means is also indicated, for example constructed as a transformer, particularly power transformer, or constructed as a choke, wherein the operating means comprises an on-load tap changer according to the improved concept. The operating means comprises a tank for filling with an insulating medium, particularly with an insulating liquid, for example an insulating oil. If the tank is filled with the insulating medium, thus particularly during operation of the operating means, the movable contact and the fixed contact are in direct contact with the insulating medium.

Alternatively, the on-load tap changer can itself comprise an insulating medium vessel for filling with an insulating medium. If the insulating medium vessel is filled with the insulating medium, the movable contact and the fixed contact are in direct contact with the insulating medium of the on-load tap changer.

Further forms of embodiment and implementations of the selector device, the on-load tap changer and the operating means are directly evident from the different forms of embodiment of the contact system and, respectively, conversely.

The invention is explained in detail in the following on the basis of exemplifying forms of embodiment with reference to the drawings. Components which are functionally identical or have an identical effect may be provided with identical reference numerals. Identical components or components with identical function are, in certain circumstances, explained only with respect to the figure in which they first appear. The explanation is not necessarily repeated in the succeeding figures.

Figure 1B:
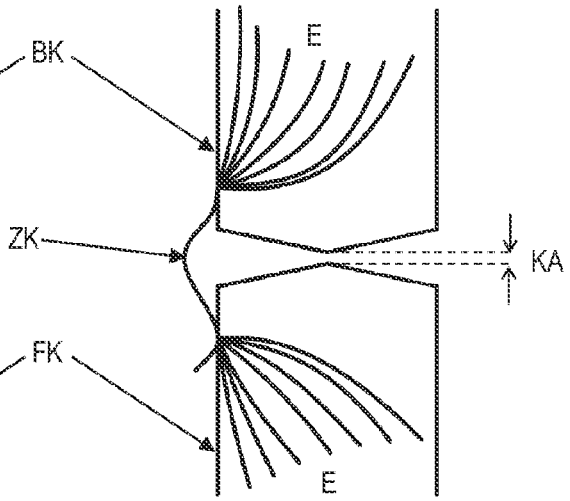

FIGS. 1A and 1B show a schematic illustration of an exemplifying form of embodiment of a contact system for an on-load tap changer according to the improved system. The contact system comprises a fixed contact FK, which is not moved during a switching-over process of the on-load tap changer, and a movable contact BK. In addition, the contact system comprises an auxiliary contact ZK, which is constructed as, for example, a sheet-metal strip, particularly of a copper alloy.

The contact system is in a stationary state in FIG. 1A, i.e. a possible switching-over process has completely concluded, a further switching-over process has not yet begun, and a current flows between movable contact BK and fixed contact FK. The movable contact BK is pressed by a contact force KK, for example produced by a spring, onto the fixed contact FK so that movable contact BK and fixed contact FK are directly in contact with one another in a first region B1. In particular, the first region B1 is present at mutually facing end faces of the movable contact BK and the fixed contact FK.

The auxiliary contact ZK is, for example, fixedly connected with the movable contact BK, in particular at an outer side of the movable contact BK. The auxiliary contact ZK contacts the fixed contact FK at a second region B2 of the fixed contact FK, in particular at an outer side of the fixed contact FK. However, there is no fixed connection here: the auxiliary contact ZK, which can, for example, be constructed to be intrinsically resilient, is pressed onto the fixed contact FK.

In this situation, the movable contact BK, directly contacts the fixed contact FK in the first region B1 and indirectly by way of the auxiliary contact ZK. Because the electrical resistance of the auxiliary contact ZK is significantly higher than that of the direct contacting, the current flows almost exclusively via the latter, as schematically indicated by corresponding lines 1.

FIG. 1B shows a situation of the same contact system, wherein here an interruption between movable contact BK and fixed contact FK has arisen. The movable contact BK has distanced itself from the fixed contact FK in opposite direction to the contact force KK by a contact spacing KA, for example due to impulse transmission by virtue of internal and/or external mechanical effects. Due to the current flow in the stationary state, an arc would therefore form between movable contact BK and fixed contact FK if the auxiliary state ZK were not present.

The auxiliary contact ZK is dimensioned and arranged in such a way that a spacing A between the regions B1 and B2 is always large enough for the indirect contacting to remain in place even when the contact spacing KA adopts a maximum value. In particular, the spacing A is at least as large as the maximum contact spacing.

It is thereby ensured that during the interruption the current is further conducted by way of the auxiliary contact ZK, which represents the path of the least electrical resistance, as the schematic lines 1 indicate. Because the duration in time of the interruption is very short, the thermal loading of the auxiliary contact ZK notwithstanding its relatively high electrical resistance and the sometimes high currents is small and therefore non-problematic. Estimations for a mass of the movable contact BK of 40 g, a contact force KK of 25 N, an interruption duration of 500 μs and a current of 200 A have given a temperature increase of the auxiliary contact SK of less than 1 K. In that case, the basis was an auxiliary contact ZK of $CuBe_2$ with a cross-section of 1 $mm^2$.

Figure 2:
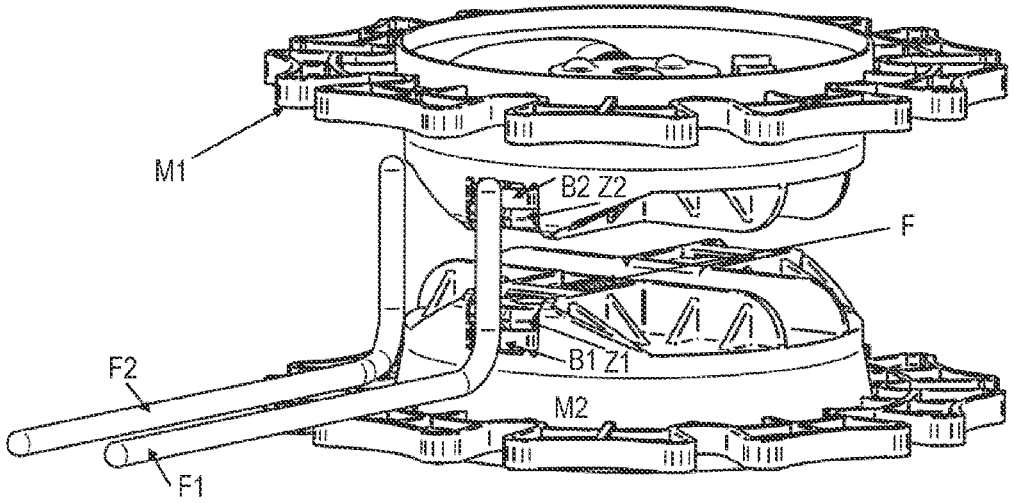
FIG. 2 shows an exemplifying form of embodiment of a selector device according to the improved concept.
Figure 3A:
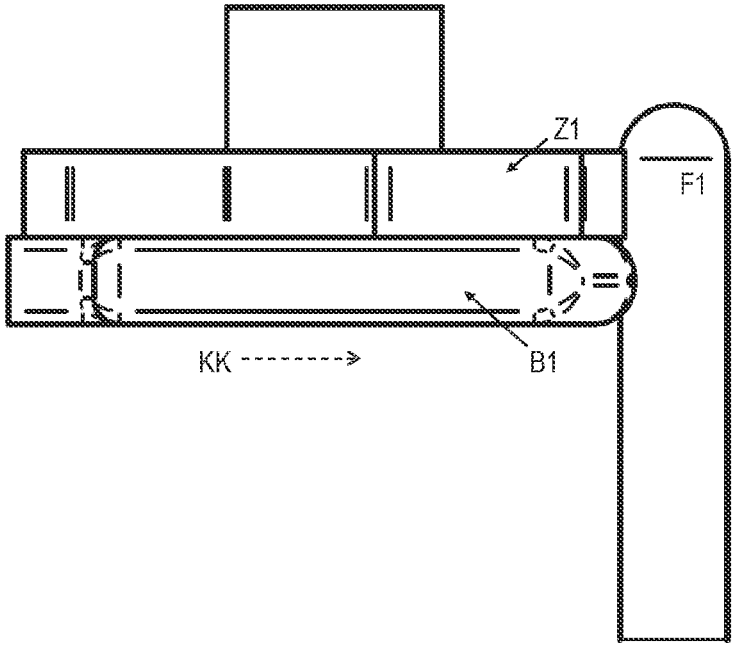
FIGS. 3A and 3B show a side view and a plan view of a further exemplifying form of embodiment of a contact system according to the improved concept.
Figure 3B:
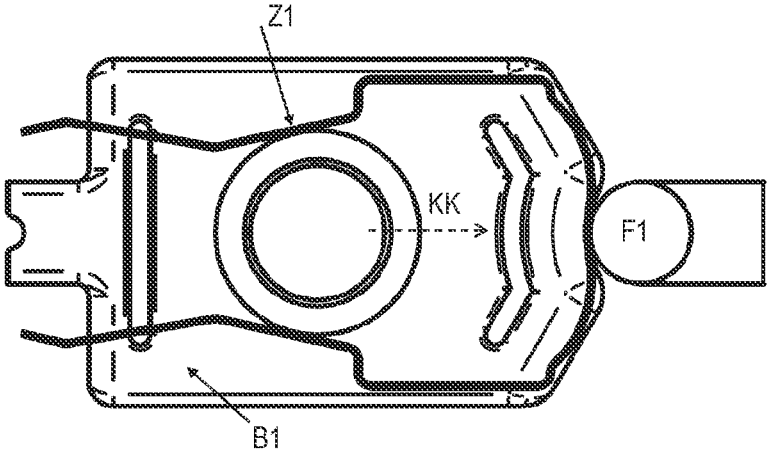

FIG. 2 shows a detail of an exemplifying selector device, in short selector, with a contact system according to the improved concept. FIG. 3A shows a part of the contact system in side view, whereas FIG. 3B shows a corresponding plan view. The selector comprises a first Geneva wheel M1 and a second Geneva wheel M2, which are arranged on opposite sides of an insulating plate. Moreover, the selector comprises a fixed contact F1 as well as further fixed contacts, of which, by way of example, two shown are F2, F3. The first Geneva wheel M1 carries a first movable contact B1 and the second Geneva wheel M2 carries a second movable contact B2. In the illustrated situation, the two movable contacts B1, B2 contact the fixed contact F1. The movable contacts B1, B2 are respectively resiliently mounted, for example by a compression spring F, on the corresponding Geneva wheel to exert a contact force KK by the movable contacts B1, B2 on the fixed contact F1.

A first auxiliary contact Z1, which is constructed as, for example, shaped sheet-metal strip, rests, for example, by an edge on the first movable contact B1 and contacts this. The first auxiliary contact Z1 contacts the fixed contact F1 by an end face. As a result, an indirect contacting of first movable contact B1 and fixed contact F1 by way of the first auxiliary contact Z1 is achieved.

The first auxiliary contact Z1 is, for example, of intrinsically resilient construction, in particular at least a part of the end face of the first auxiliary contact Z1 is resiliently deformable parallel to the contact force KK. As a result, in the stationary state, an auxiliary contact force is exerted parallel to the contact force KK from the first auxiliary contact Z1 to the fixed contact F1. In addition, the mass of the first auxiliary contact Z1 is substantially smaller, for example at least by a factor 10, than the mass of the first movable contact B1.

This construction has the consequence that, in the case of an interruption between first movable contact B1 and fixed contact F1, the indirect contacting is maintained by way of the first auxiliary contact Z1 and formation of an arc is prevented.

The contact system optionally comprises a second auxiliary contact Z2, which is arranged with respect to the second movable contact B2 in corresponding manner to the first auxiliary contact Z1 with respect to the first movable contact B1. The above explanations with respect to the first movable contact B1 and the first auxiliary contact Z1 then apply correspondingly.

The selector is arranged for the purpose of actuating the Geneva wheels M1, M2 by way of a drive of the on-load tap changer, particularly a drive shaft. This actuation is carried out, for example, in such a way that during a switching-over process initially the first movable contact B1 is switched, free of current, from one of the further fixed contacts F2, F3 to the fixed contact F1. In the stationary state, the current then can flow between fixed contact F1 and the first movable contact B1. The second movable contact B2 is then similarly switched, for example, from one of the further fixed contacts F2, F3 to the fixed contact F1.

Formation of an arc in an on-load tap changer can be reduced by the different forms of embodiment of a contact system, a selector device or an on-load tap changer. As a result, on the one hand wear of the contact system by contact burning can be reduced. On the other hand, contamination of the insulating liquid of on-load tap changer and/or operating means is also reduced. The maintenance intervals of the on-load tap changer and/or the operating means, or the corresponding service lives, are thus lengthened. Use of the on-load tap changer even under external shock loading is made possible.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

| | |
|---|---|
| fixed contacts | FK, F1, F2 |
| movable contacts | BK, B1, B2 |
| auxiliary contacts | ZK, Z1, Z2 |
| Geneva wheels | M1, M2 |
| contact force | KK |
| lines for current | 1 |
| spring | F |
| spacing | A |
| contact spacing | KA |
| contact regions | B1, B2 |

The invention claimed is:

1. A contact system for an on-load tap changer, the contact system comprising:

a fixed contact;

a movable contact configured to directly contact, in a stationary state, the fixed contact; and an auxiliary contact, which, in addition to the direct contacting, is configured to electrically connect the movable contact with the fixed contact in the stationary state;

wherein the auxiliary contact is constructed and arranged to temporarily conduct a current between the fixed contact and the movable contact in the event of interruption in which the direct mechanical connection between the moveable contact and the fixed contact is temporarily interrupted and immediately reinstated after the interruption, and wherein in the stationary state:

the movable contact is configured to contact the fixed contact at a first region;

the auxiliary contact is configured to contact the fixed contact at a second region; and the first region and the second region are configured to have a mutual spacing larger than or equal to a predetermined minimum spacing.

2. The contact system according to claim 1, wherein the auxiliary contact:

is mechanically coupled with the movable contact in such a way that the auxiliary contact moves in company with the movable contact; or is mechanically coupled with the fixed contact.

3. The contact system according to claim 1, wherein in the stationary state:

the moveable contact is configured to exert a contact force on the fixed contact;

the auxiliary contact is configured to exert a further contact force parallel to the contact force on the fixed contact; and at least a part of the auxiliary contact and the movable contact are movable relative to one another in the direction of the contact force.

4. The contact system according to claim 1, wherein a mass of the auxiliary contact is smaller than a mass of the movable contact by at least an order of magnitude.

5. The contact system according to claim 1, wherein the auxiliary contact is:

intrinsically resilient; or resiliently attached to or mounted on the movable contact; or resiliently attached to or mounted on a component, which is moveable in company with the movable contact, of the contact system.

6. The contact system according to claim 1, wherein the interruption corresponds with the creation of a spacing between the movable contact and the fixed contact.

7. The contact system according to claim 1, wherein the auxiliary contact comprises a beryllium bronze or a tin bronze.

8. A selector device for an on-load tap changer, the selector device comprising the contact system according to claim 1.

9. The selector device according to claim 8, comprising an insulating plate with a first side and a second side opposite the first side, wherein:

the movable contact is arranged on the first side;

the contact system comprises a further movable contact, which is arranged on the second side; and the further movable contact is arranged to directly contact the fixed contact.

10. The selector device according to claim 9, which is configured to switch over the movable contact from a further fixed contact of the contact system to the fixed contact and thereafter to switch over the further movable contact from the further fixed contact or from an additional further fixed contact to the fixed contact.

11. The selector device according to claim 9, comprising a Geneva wheel which is attached to the insulating plate to be rotatable about an axis and which carries the movable contact.

12. An on-load tap changer comprising the contact system according to claim 1.

13. The on-load tap changer according to claim 12, wherein the on-load tap changer is constructed for current-free switching over of the movable contact from the fixed contact to a further fixed contact of the contact system.

14. An inductive operator comprising the on-load tap changer according to claim 12 and a tank configured to receive an insulating medium, wherein the movable contact and the fixed contact are arranged to be in direct contact with the insulating medium in a state where the tank is filled with the insulating medium.

* * * * *